United States Patent [19]

Sung et al.

[11] Patent Number: 4,758,363

[45] Date of Patent: Jul. 19, 1988

[54] OXIDATION AND CORROSION RESISTANT DIESEL ENGINE LUBRICANT

[75] Inventors: Rodney L. Sung, Fishkill; Benjamin H. Zoleski, Beacon; Ronald L. O'Rourke, Hyde Park, all of N.Y.

[73] Assignee: Texaco Inc., White Plains, N.Y.

[21] Appl. No.: 115,491

[22] Filed: Nov. 2, 1987

[51] Int. Cl.[4] ..... C10M 133/28

[52] U.S. Cl. ..... 252/51.5 R; 252/565; 252/50

[58] Field of Search ..... 252/51.5 R, 51.5 A, 252/565, 50

[56] References Cited

U.S. PATENT DOCUMENTS 3,897,421 7/1975 Aebli ..... 252/22
4,064,059 12/1977 Nebzydoski ..... 252/51.5 A
4,298,481 11/1981 Clarke ..... 252/565
4,426,300 1/1984 Dexheimer ..... 252/8.9

*Primary Examiner*—William R. Dixon, Jr.
*Assistant Examiner*—James M. Hunter, Jr.
*Attorney, Agent, or Firm*—Robert A. Kulason; James J. O'Loughlin; Louis S. Sorell

[57] ABSTRACT

An oxidation and corrosion resistant diesel engine lubricant composition, particularly useful in marine and railway diesel engines, comprises a major amount of a base hydrocarbon lubricating oil and from 0.1–5.0 weight percent of a reaction product additive which is the reaction product obtained by first reacting a hydroxybenzoic acid and a polyoxyalkylene polyol to form an ester, and thereafter reacting the ester with an aldehyde or ketone and a substituted or unsubstituted heterocyclic azole to produce the final reaction product.

24 Claims, No Drawings

OXIDATION AND CORROSION RESISTANT DIESEL ENGINE LUBRICANT

BACKGROUND OF THE INVENTION

1. Field of the Invention

This invention relates to a diesel engine crankcase lubricating composition which exhibits improved resistance to corrosion and oxidation. More particularly, this invention relates to a novel corrosion and oxidation resistant diesel engine crankcase lubricating composition comprising a major amount of a hydrocarbon lubricating oil and a minor amount of a reaction product prepared by first reacting a hydroxybenzoic acid with a polyoxyalkylene polyol to produce an ester, and thereafter reacting the esterification product with an aldehyde or ketone and a substituted or unsubstituted heterocyclic azole reactant to form the final reaction product. The instant invention is particularly useful as a lubricant in large diesel engines such as marine and railway diesel engines.

2. Information Disclosure Statement

As is well known to those skilled in the art, lubricating oils must be characterized by resistance to oxidation and corrosion inhibition. Since the oils used as lubricants in the crankcases of large diesel engines, such as marine and railway diesel engines, are subject to unique conditions of operation, special attention must be directed to the potential problems which are to be encountered.

One particular problem related to railway diesel engine oil is due to the practice in the railroad industry of mixing poorer grade fuels (such as marine residual) with the regular D-2 diesel fuel. While there is a savings associated with the use of these mixed fuels, engine performance problems such as increased corrosion and poorer oxidative stability often arise. In addition, the advent of new, more fuel efficient railway diesel engines has put a greater demand on the oxidation resistance of railway diesel lubricants. Oxidized lubricants lead to increased corrosive attack of engine metal surfaces; consequently, lubricants employed in newer railway diesel engines must be changed more frequently to prevent such corrosive attack.

In view of the above, diesel engine lubricant compositions have previously been specifically formulated containing anti-wear additives, demulsifying agents, oxidation and corrosion inhibitors and other additives. For example:

- Co-assigned U. S. patent application Ser. No. 115,330, filed Nov. 2, 1987 (Sung et al.) discloses an oxidation and corrosion-resistant diesel engine lubricant composition comprising a major amount of a hydrocarbon lubricating oil and a minor amount of the reaction product of an n-acyl sarcosine and a substituted or unsubstituted heterocyclic axole;
- Co-assigned U.S. patent application Ser. No. 945,599, filed Dec. 23, 1986 (Sung et al.) discloses a haze, oxidation, and corrosion-resistant diesel engine lubricant composition which comprises a major amount of a hydrocarbon lubricating oil and a minor amount of the reaction product of an anhydride compound, a hydrocarbon-substituted mono primary amine or ether amine, and a nitrogen-containing hetercyclic azole or polyalkylene polyamine compound;
- Co-assigned U.S. Pat. No. 4,464,276 (Sung et al.) describes the preparation of novel polyoxyalkylene polyamine-triazle complexes and their use in diesel lubricant compositions as antioxidants and corrosion-inhibitors;
- Co-assigned U.S. Pat. No. 4,285,823 (Sung et al.) discloses a diesel engine lubricant composition comprising a corrosion inhibitor which is the reaction product of an N-alkyl-1,3 propane diamine, formaldehyde, and a 5-aminotetrazole;
- U.S. Pat. No. 3,791,971 (Lowe) discloses a lubricating oil composition comprising an additive which may be a polyol compound or a reaction product of a polyol compound and mono or polyisocyanates, mono or dicarboxylic acids, or acid halides and anhydrides; and
- U.S. Pat. No. 3,684,734 (Liebold et al.) discloses the use of the esterification product of (i) a polyoxyethylene-polyoxypropylene block copolymer and (ii) an aliphatic or aromatic hydroxycarboxylic acid as a demulsifier for crude oil emulsions.

The use of propylene oxide-ethylene oxide backbone polyol reaction products as additives in motor fuel compositions is also known to those skilled in the art. For example:

- Co-assigned U.S. Pat. No. 4,551,152 (Sung) discloses a wear-inhibiting additive for motor fuel compositions which is obtained by reacting a polyol with a carboxy phenol to form an ester, and thereafter reacting the ester with an aldehyde or ketone and an N-alkyl-alkylene diamine; and
- Co-assigned U.S. Pat. No. 4,430,093 (Jenkins et al.) discloses a diesel fuel additive which is the reaction product of a polyol compound having a propylene oxide-ethylene oxide backbone and a benzophenone tetracarboxylic dianhydride.

It is an object of this invention to provide a novel diesel engine lubricant composition. It is another object of this invention to provide a novel lubricant composition, suitable for use in large marine and railway diesel engines, characterized by its resistance to oxidation and corrosion. It is yet another object of this invention to provide a method of preparing such a diesel engine lubricant composition.

It is a feature of this invention that a diesel engine lubricant comprising a major amount of a hydrocarbon lubricating oil and a minor amount of the reaction product of the instant invention is characterized by its resistance to oxidation and corrosion. It is another feature of this invention that such a diesel engine lubricant composition is particularly suitable for use in large marine and railway diesel engines.

It is an advantage of this invention that the corrosion of diesel engine metal surfaces is reduced by employing this invention as a lubricant. It is another advantage that lubricants of the instant invention may be changed less frequently than other conventional diesel engine lubricants. It is yet another advantage that lubricants of the instant invention tend to resist oxidation and viscosity increase when contaminated with marine residual fuel.

SUMMARY OF THE INVENTION

The instant invention relates to a diesel engine crankcase lubricant composition which exhibits improved corrosion and oxidation resistance as compared with conventional diesel engine lubricant formulations. The novel lubricant composition of the instant invention comprises a major proportion of a hydrocarbon lubricating oil and from about 0.1 to 5.0 weight percent, preferably 0.5–2.0 weight percent (based on the lubricating oil) of the reaction product prepared by: (a) first forming an ester by reacting at a temperature range of 50° C.–150° C. substantially equimolar amounts of a hydroxybenzoic acid, preferably salicyclic or p-hydroxybenzoic acid, most preferably salicyclic acid, and a polyoxyalkylene polyol of the formula $$OH-(CH_2CH_2O)_a-(\underset{\underset{CH_3}{|}}{C}HCH_2O)_b-(CH_2CH_2O)_c-H$$

where a+c has a value in the range of 1–20, preferably 2–16, most preferably 2.2, and b has a value in the range of 5–50, preferably 14–≅, most preferably 14.7; and (b) thereafter further reacting at an elevated temperature the esterification product with equimolar amounts of an aldehyde or ketone, most preferably paraformaldehyde, and a substituted or unsubstituted heterocyclic azole, preferably selected from the group consisting of tolyltriazole, benzotriazole, aminotriazole, aminotetrazole, aminomercaptothiadiazole, and benzomercaptothiazole, most preferably 5-aminotriazole.

This invention is also directed to a method of preparing the abovedescribed diesel engine lubricating oil.

DESCRIPTION OF THE PREFERRED EMBODIMENTS

The diesel lubricant compositions of the instant invention include lubricating oils which are employed in large diesel engines, particularly in the crankcases of large diesel engines such as are found in marine service, and in large railway diesel engines.

The novel corrosion and oxidation resistant diesel engine lubricating oil of the instant invention comprises a major amount of a base hydrocarbon lubricating oil and from 0.1 to 5.0 weight percent, preferably 0.5 to 2.0 weight percent of a corrosion and oxidation-inhibiting additive which is the reaction product obtained by first reacting a hydroxybenzoic acid and a polyoxalkylene polyol to produce an ester, and thereafter reacting the esterification product with an aldehyde or ketone and a substituted or unsubstituted heterocyclic azole to form the final reaction product additive.

The base hydrocarbon oil which may be employed to prepare the lubricating oil composition of the invention includes naphthenic base, paraffinic base and mixed base mineral oils, lubricating oil derived from coal products and synthetic oils, e.g. alkylene polymers such as polypropylene and polyisobutylene of a molecular weight of between about 250 and 2500. In the case of marine diesel engine lubricants, the preferred lubricant is typicaly a hydrocarbon lubricating oil having a Total Base Number (TBN) of 3–8, say 6 made up for example by blending a paraffinic Solvent Neutral Oil (SNO-20) having a VI of ca 92 and a viscosity of 47–53 CSt at 40° C. and 6.65–7.15 at 100° C. with a paraffinic Solvent Neutral Oil (SNO-50) having a VI of ca 93 and a viscosity of 158–180 CSt at 40° C. and 15.3–16.4 at 100° C. In the case of railway diesel engine lubricants, the preferred lubricant is typically a hydrocarbon lubricating oil having a TBN of 3–20, say 10–171 made up for example by blending a paraffinic Solvent Neutral Oil (SNO-320) of a viscosity of 7.82–8.70, say 8.26 CSt at 100° C., a paraffinic Solvent Neutral Oil (SNO-850) of a viscosity of 13.8–14.8, say 14.6 CSt at 100° C., and a naphthenic pale oil of a viscosity of 8.0–15.0, say 14.2 CSt at 100° C.

Typically, the lubricant composition of the instant invention may contain minor amounts of additional additives. Table I set forth illustrative additives which may be employed in admixture with the instant invention when it is used as a marine diesel engine lubricant.

TABLE I

| Additive Function | Broad Range (wt. %) | Illustrative Additive |
|---|---|---|
| Anti-wear Agent | 0.1–1 | Zinc dialkyl dithiophosphate |
| Oxidation Inhibitor | 0.1–1 | alkylated diphenyl amine |
| Demulsifying Agents | 50–200 ppm | dimethyl polysiloxane (a silicone) |
| Detergent | 1–5 | Overbased sulfurized calcium alkylphenolate |
| Anti-Rust Agent | 0.1–5 | Ethoxylated nonyl phenol |

When the lubricant composition of the instant invention is used as a railway diesel engine lubricant, additional additives or additive packages may also be employed. Illustrative examples of commercially available additive concentrate packages include ORONIT OLOA 2939 (commercially available from Chevron Chemical Company) and Amoco 6555 (commercially available from Amoco Chemical Company) which may be employed in admixture with the lubricant composition of the instant invention. The compositions of such additive packages are set forth in Table II.

TABLE II

| Additive | Typical Concentration (wt. %)* OLOA 2939 | Amoco 6555 |
|---|---|---|
| Overbased mixed calcium petroleum sulfonate/phenolate | 45.0[1] | 28.0[2] |
| Polyisobutenyl succinimide/amide | 10.0 | 10.0[3] |
| Polyisobutylene | 1.5 | 3.0 |
| Paraffinic Mineral Oil | 43.0 | 52.0 |
| Chloroparaffin | 0.5 | 1.0 |
| Branched alkylphenol | — | 6.0 |

*Wt. % concentration based on total weight of additive concentrate package.
[1]Approx. 5:1 sulfonate to phenolate (phenolate may be sulfurized).
[2]Approx. 1:1 sulfonate to phenolate.
[3]Ca salt of polyisobutenyl phenol-aldehyde-amine reaction product.

The reaction product additive of the instant invention is prepared by first reacting substantially equimolar amounts of a hydroxybenzoic acid and a polyoxyalkylene polyol at a temperature range of 50° C.–150° C. to form an ester, and thereafter reacting the ester at an elevated temperature with equimolar amounts of an aldehyde or ketone and a substituted or unsubstituted heterocyclic azole to form the final reaction product.

The hydroxybenzoic acid reactant may be one bearing a carboxy group on the hydroxy benzene ring which may be derived from alkyl, aryl, alkaryl, aralkyl, or cycloalkyl benzene. The preferred hydroxybenzoic acids for use are salicyclic acid and p-hydroxybenzoic acid, with salicyclic acid being particularly preferred.

The polyoxyalkylene polyol reactant is preferably a polyol containing a block copolymer of propylene oxide and ethylene oxide moieties, the polyol having a molecular weight $M_n$ in the range of about 500–5000, preferably about 750–3500, most preferably about 900–2000. The polyoxyalkylene polyol reactant is of the formula:

$$OH-(CH_2CH_2O)_a-(\underset{\underset{CH_3}{|}}{CH}-CH_2O)_b-(CH_2CH_2O)_c-H$$

where a+c has a value ranging from 1–20, preferably 2–16, most preferably 2.2, and b has a value ranging from 5–50, preferably 14–25, most preferably 14.7. Polyoxyalkylene polyol reactants suitable for use in preparing the novel reaction product of the instant invention include polyols such as those commercially available from the BASF Wyandotte Corporation under the PLURONIC series tradename. Examples of such polyols include those in Table III below, the first-listed polyol being particularly preferred.

TABLE III

A. The BASF Wyandotte PLURONIC L-31 brand of poly (oxyethylene) poly (oxypropylene) poly (oxyethylene) polyol having a molecular weight $M_n$ of 950 and containing 10 wt. % derived from poly (oxyethylene) and 90 wt. % derived from poly (oxypropylene). In this polyol, b is 14.7 and a + c is 2.2.

B. The BASF Wyandotte PLURONIC L-63 brand of poly (oxyethylene) poly (oxypropylene) poly (oxyethylene) polyol having a molecular weight $M_n$ of 1750 and containing 30 wt. % derived from poly (oxyethylene) and 70 wt. % derived from poly (oxypropylene). In this polyol, b is 21.1 and a + c is 11.9.

C. The BASF Wyandotte PLURONIC L-62 brand of poly (oxyethylene) poly (oxypropylene) poly (oxyethylene) polyol having a molecule weight $M_n$ of 1750 and containing 20 wt. % derived from poly (oxyethylene) and 80 wt. % derived from poly (oxypropylene). In this polyol, b is 24.1 and a + c is 8.

D. The BASF Wyandotte PLURONIC L-43 brand of poly (oxyethylene) poly (oxypropylene) poly (oxyethylene) polyol having a molecule weight $M_n$ 1200 and containing 30 wt. % derived from poly (oxyethylene) and 70 wt. % derived from poly (oxypropylene). In this polyol, b is 16.6 and a + c is 5.5.

E. The BASF Wyandotte PLURONIC L-64 brand of poly (oxyethylene) poly (oxypropylene) poly (oxyethylene) polyol having a molecule weight $M_n$ 1750 and containing 40 wt. % derived from poly (oxyethylene) and 60 wt. % derived from poly (oxypropylene). In this polyol, b is 18.1 and a + c is 15.9.

The heterocyclic azole reactant may be any substituted or unsubstituted heterocyclic azole, but preferably is selected from the group consisting of tolyltriazole (hereinafter referred to as TTZ), benzotriazole (hereinafter referred to as BTZ), aminotriazole (hereinafter referred to a ATZ), aminotetrazole (hereinafter referred to as ATTZ), aminomercaptothiadiazole (hereinafter referred to as AMTZ), and benzomercaptothiazole (hereinafter referred to as BMTZ).

If an aminotriazole reactant is employed, it preferably will be a 3-, 4-, or 5-aminotriazole (hereinafter referred to as 3-ATZ, 4-ATZ, or 5-ATZ, respectively), including those bearing inert substituents, typified by hydrocargon or alkoxy groups, which do not react in the instant invention. The most preferred aminotriazole reactant is 5-ATZ. If an aminotetrazole reactant is employed, it preferably will be a 4-or 5-aminotetrazole (hereinafter referred to as 4-ATTZ or 5-ATTZ, respectively), again including those bearing inert substituents, typified by hydrocarbon or alkoxy groups which do not react in the instant invention. If an aminomercaptothiadiazole reactant is employed, it preferably will be a 5-aminomercaptothiadiazole. 5-ATZ is the most preferred heterocyclic azole reactant for use in the instant invention.

In a preferred mode of preparing the reaction product, substantially equimolar amounts of the hydroxybenzoic acid and polyoxyalkylene polyol reactants are mixed together with an excess of a non-alcohol solvent. Typical solvents which may be employed include hydrocarbons including heptane, octane, toluene, xylene, gasoline, etc. Xylene is particularly preferred for use as a solvent. A catalytic amount of p-toluenesulfonic acid may also be present to further the esterification reaction. The esterification reaction mixture is then refluxed at a temperature range of 50° C.–150° C., until such time as no more water can be removed from the reaction mixture. The esterification reaction may generally be completed in from about 0.1–10 hours, although longer time may be required for large quantities. After the water is removed from the system, the esterification reaction product is filtered and stripped of the solvent using conventional means.

A portion or all of the esterification reaction product is then reacted with equimolar amounts of the substituted or unsubstituted heterocyclic azole reactant and the aldehyde or ketone reactant at an elevated temperature. Preferred aldehydes for use include acetalaldehyde, formaldehyde, paraformaldehyde, butyraldehyde, cyclohexaldehyde, and benzaldehyde, with paraformaldehyde being particularly preferred. Preferred ketones for use include acetone, benxophenone, methyl ethyl ketone, and acetophenone, with acetone being particularly preferred. Parafromaldehyde is the most preferred reactant. The reaction mixture is reacted at an elevatd temperature until such time as no more water can be removed. After all the water is removed from the system, the final reaction product may be filtered and stripped via conventional means, or left in admixture with solvent to facilitate admixture into the base hydrocarbon lubricating oil.

The following examples illustrate the preferred method of preparing the reaction product. It will be understood that the following examples are merely illustrative, and are not meant to limit the invention in any way. In the examples, all parts are parts by weight unless otherwise specified.

EXAMPLE 1

In a preferred mode of preparing the reaction product additive of the instant invention, 475 parts of a polyoxyalkylene polyol of the formula $$OH-(CH_2CH_2O)_a-(\underset{\underset{CH_3}{|}}{CH}CH_2O)_b-(CH_2CH_2O)_c-H$$

where a+c has a value of about 2.2 and b has a value of about 14.7 was reacted with 69.1 parts of salicyclic acid in 400 ml of xylene at the reflux temperature of xylene and azeotroped until no more water could be removed from the system. The esterification reaction product was cooled, filtered and stripped of remaining solvent under a vacuum. Thereafter, 53.5 parts of the esterification reaction product was reacted with 4.1 parts of 5-ATZ and 3 parts of paraformaldehyde at the reflux temperature of the mixture and azeotroped until no more water could be removed from the system. The reaction mixture was cooled, filtered and stripped under a vacuum to yield the final reaction product.

EXAMPLE 2

In another preferred mode of preparing the reaction product additive of the instant invention, 475 parts of a polyoxalkylene polyol of the formula $$OH-(CH_2CH_2O)_a-(\underset{\underset{CH_3}{|}}{C}HCH_2O)_b-(CH_2CH_2O)_c-H$$

where a+c has a value of about 2.2 and b has value of about 14.7 was reacted with 69.1 parts of salicyclic acid in 400 ml of xylene at the reflux temperature of xylene and azeotroped until no more water could be removed from the system. The esterification reaction product was cooled, filtered and stripped of remaining solvent under a vacuum. Thereafter, 54 parts of the esterification reaction product in admixture with 200 ml of xylene was reacted with 6.6 parts of 5-AMTZ and 3 parts of paraformaldehyde at the reflux temperature of the mixture and azeotroped until no more water could be removed from the system. The reaction mixture was cooled, filtered and stripped under a vacuum to yield the final reaction product.

The reaction product additive may be added to the base lubricating oil in minor, effective, corrosion inhibiting amounts of about 0.1–5.0 wt. %. Lesser quantities may be employed, but the degree of improvement so obtained may be lessened thereby. Larger amounts may be employed, but no significant additional improvement is thereby attained. Preferably the effective amount is about 0.5–2.0 wt. %, say about 1.0 wt. % based on the lubricating oil. The reaction product compound may be added separately or as a component of an additive package which contains other additives.

Presence of the above-described reaction product compound in a diesel engine lubricating oil such as a railway diesel engine lubricant is found to be particularly advantageous in controlling the degradation characteristics of the lubricant. Degradation of the lubricant often leads to higher acid concentrations within the lubricant, which may in turn lead to corrosive attack of metallic engine surfaces. This is particularly a problem when the lubricant has been contaminated with a given amount of marine diesel residual fuel which was initially added to extend the base diesel fuel.

The Union Pacific Oxidation Test (UPOT) was employed to determine the degradation characteristics of lubricant compositions of the instant invention and a conventional lubricant composition under the scenario in which all of the lubricant compositions have been contaminated with a given amount of marine diesel redidual fuel. It is believed that this is a realistic test since during normal engine operation D-2 diesel fuel often enters with the engine cranckcase, thereby contaminating the engine lubricant.

The test method involves bubbling 5 liters of oxygen per hour through 300 ml. of test oil composition at 285° F. in which there is immersed a 1×3×0.06 inch steel backed copper-lead test specimen cut from bearing stock. The viscosity of the test oil is measured before and after the 144 hour test period and the greater the difference in viscosity the greater the oxidative deterioration of the instant invention. In addition, the test specimen is weighed before and after the test period and the greater the weight loss of test specimen the greater the corrosion deterioration of the test formulation. Further, the larger amount of copper, iron and lead moieties found in the oil after test the greater the oxidative corrosion deterioration thereof.

The following examples and UPOT results further illustrate the superiority of the instant invention in controlling degradation characteristics of diesel engine lubricants, particularly railway diesel engine lubricants.

EXAMPLE 3

In this control example, a railway diesel engine lubricant contaminated with marine diesel residual fuel was formulated containing the following components:

| Component | wt. % |
|---|---|
| (i) Paraffinic Solvent Neutral Oil (SNO-320) | 15.60 |
| (ii) Paraffinic Solvent Neutral Oil (SNO-850) | 27.06 |
| (iii) Naphthenic pale oil of viscosity 14.2 CSt at 100° C. | 37.30 |
| (iv) ARCO 6555 brand additive package* | 14.64 |
| (v) Marine Diesel Fuel | 5.0 |

*See Table II

This formulation was tested via the UPOT and found to have a total weight loss of 0.2574 gm and a viscosity increase of 82.0%.

EXAMPLE 4

A lubricant formulation was made up containing a 99 wt. % of the marine diesel fuel contaminated base lubricant of Example 3 and 1.0 wt. % of the reaction product of Example 1. It was tested via the UPOT and found to have a total weight loss of 0.0163 gm and a viscosity increase of 28.6%.

EXAMPLE 5

A lubricant formulation was made up containing 99 wt. % of the marine diesel fuel contaminated base lubricant of Example 3 and 1.0 wt. % of the reaction product of Example 2. It was tested via the UPOT and found to have a total weight loss of 0.2308 gm and a viscosity increase of 113.5%.

As demonstrated by a comparison of the UPOT results for Examples 3–5, a composition of the instant invention formulated for use as a railway diesel engine lubricant and contaminated with marine diesel fuel (Example 4) showed both lower total weight loss (hence less corrosive attack) and lower viscosity increase (hence less oxidation) than a conventional lubricant contaminated with marine diesel fuel (Example 3). Another composition of the instant invention (Example 5) showed a lower total weight loss (hence less corrosive attack) but a higher viscosity increase (hence greater oxidation) than the conventional lubricant of Example 3. Thus, although formulations of the instant invention as illustrated by Example 5 are superior to conventional formulations (e.g. Example 3), formulations of the instant invention as per Example 4 are particularly preferred.

Although this invention has been illustrated by reference to specific embodiments, it will be apparent to those skilled in the art that various changes and modifications may be made which clearly fall within the scope of this invention. For example, reaction product compositions of the instant invention may also be useful as corrosion inhibitors in other types of commpositions such as motor fuels, alcohols, metal working fluids, and the like.

The invention claimed is:

1. A diesel engine lubricating oil composition comprising a major amount of a hydrocarbon lubricating oil and from 0.1–5.0 weight percent of the reaction product prepared by:

(a) first forming an ester by reacting at a temperature range of 50° C.–150° C. substantially equimolar amounts of a hydroxybenzoic acid and a polyoxyalkylene polyol of the formula $$OH-(CH_2CH_2O)_a-(\underset{\underset{CH_3}{|}}{C}HCH_2O)_b-(CH_2CH_2O)_c-H$$

where a+c has a value in the range of 1–20 and b has a value in the range of 5–50; and (b) thereafter further reacting at an elevated temperature said ester with equimolar amounts of an aldehyde or ketone and a substituted or unsubstituted heterocyclic azole.

2. A lubricating oil composition according to claim 1, where said hydroxybenzoic acid is salicyclic acid.

3. A lubricating oil composition according to claim 1, where said hydroxybenzoic acid is p-hydroxybenzoic acid.

4. A lubricating oil composition according to claim 1, where said polyoxyalkylene polyol is of the formula $$OH-(CH_2CH_2O)_a-(\underset{\underset{CH_3}{|}}{C}HCH_2O)_b-(CH_2CH_2O)_c-H$$

where a+c has a value in the range of 2–16, and b has a value in the range of 14–25.

5. A lubricating oil composition according to claim 4, where a+c has a value of about 2.2 and b has a value of about 14.7.

6. A lubricating oil composition according to claim 4, where a+c has a value of about 11.9 and b has a value of about 21.1.

7. A lubricating oil composition according to claim 4, where a+c has a value of about 8 and b has a value of about 24.1.

8. A lubricating oil composition according to claim 4, where a+c has a value of about 5.5 and b has a value of about 16.6.

9. A lubricating oil composition according to claim 4, where a+c has a value of about 15.9 and b has a value of about 18.1.

10. A lubricating oil composition according to claim 1, where said heterocyclic azole reactant is an aminotriazole.

11. A lubricating oil composition according to claim 10, where said aminotriazole is 5-aminotriazole.

12. A lubricating oil composition according to claim 1. where said heterocyclic azole reactant is an aminotetrazole.

13. A lubricating oil composition according to claim 12, where said aminotetrazole is selected from the group consisting of 4- and 5-aminotetrazole.

14. A lubricating oil composition according to claim 1, where said heterocyclic azole reactant is an aminomercaptothiadiazole.

15. A lubricating oil composition according to claim 14, where said aminomercaptothadiazole is a 5-aminomercaptothiadiazole.

16. A lubricating oil composition according to claim 1, where said heterocyclic azole reactant is a benzomercaptothiazole.

17. A lubricating oil composition according to claim 1, where said heterocyclic azole reactant is benzotriazole.

18. A lubricating oil composition according to claim 1, where said heterocyclic azole reactant is tolyltriazole.

19. A lubricating oil composition according to claim 1, where said aldehyde reactant is paraformaldehyde.

20. A diesel engine lubricating oil composition comprising a major amount of a hydrocarbon lubricating oil and from 0.1–5.0 weight percent of the reaction product prepared by:

(a) first forming an ester by reacting at a temperature range of 50° C.–150° C. substantially equimolar amounts of salicyclic acid and a polyoxyalkylene polyol of the formula $$OH-(CH_2CH_2O)_a-(\underset{\underset{CH_3}{|}}{C}HCH_2O)_b-(CH_2CH_2O)_c-H$$

where a+c has a value of about 2.2 and b has a value of about 14.7; and (b) thereafter further reacting at an elevated temperature said ester with equimolar amounts of 5-aminotriazole and paraformaldehyde.

21. A lubricating oil composition as in any one of the preceding claims, in which said composition comprises a major amount of a hydrocarbon lubricating oil and from 0.5–2.0 weight percent of said reaction product.

22. A method of preparing a diesel engine lubricating oil composition which comprises adding to a major portion of a hydrocarbon lubricating oil 0.1–5.0 weight percent of a reaction product prepared by:

(a) first forming an ester by reacting at a temperature range of 50° C.–150° C. substantially equimolar amounts of a hydroxybenzoic acid and a polyoxyalkylene polyol of the formula $$OH-(CH_2CH_2O)_a-(\underset{\underset{CH_3}{|}}{C}HCH_2O)_b-(CH_2CH_2O)_c-H$$

where a+c has a value in the range of 1–20 and b has a value in the range of 5–50; and (b) thereafter further reacting at an elevated temperature said ester with equimolar amounts of an aldehyde or ketone and a substituted or unsubstituted heterocyclic azole.

23. A method of preparing a diesel engine lubricating oil composition which comprises adding to a major portion of a hydrocarbon lubricating oil 0.1–5.0 weight percent of a reaction product prepared by:

(a) first forming an ester by reacting at a temperature range of 50° C.–150° C. substantially equimolar amounts of salicyclic acid and a polyoxyalkylene polyamine of the formula $$OH-(CH_2CH_2O)_a-(\underset{\underset{CH_3}{|}}{C}HCH_2O)_b-(CH_2CH_2O)_c-H$$

where a+c has a value of about 2.2, and b has a value of about 14.7; and (b) thereafter further reacting at an elevated temperature said ester with equimolar amounts of 5-aminotriazole and paraformaldehyde.

24. The method of either of claims 22 or 23, in which 0.5–2.0 weight percent of said reaction product is added to said hydrocarbon lubricating oil.

* * * * *

UNITED STATES PATENT AND TRADEMARK OFFICE

CERTIFICATE OF CORRECTION

PATENT NO. : 4,758,363

DATED : July 19, 1988

INVENTOR(S) : R. L. SUNG; B. H. ZOLESKI; R. L. O'ROURKE

It is certified that error appears in the above—identified patent and that said Letters Patent is hereby corrected as shown below:

In the Specification:
Column 3, line 5, change "salicyclic" to --salicylic--.
Column 3, line 6, change "salicyclic" to --salicylic--.
Column 3, line 15, change "14-≙" to --14-25--.
Column 4, line 24, change "ORONIT" to --ORONITE--.
Column 4, line 60, change "salicyclic" to --salicylic--.
Column 4, line 61, change "salicyclic" to --salicylic--.
Column 5, lines 51-52, change "hydrocargon" to --hydrocarbon--.
Column 6, line 25, change "Parafromaldehyde" to --Paraformaldehyde--.
Column 6, line 51, change "salicyclic" to --salicylic--.
Column 7, line 7, change "salicyclic" to --salicylic--.

In the Claims:
Claim 2, Column 9, line 16, change "salicyclic" to --salicylic--.
Claim 20, Column 10, line 12, change "salicyclic" to --salicylic--.
Claim 23, Column 10, line 53, change "salicyclic" to --salicylic--.

Signed and Sealed this

Thirteenth Day of December, 1988

*Attest:*

DONALD J. QUIGG

*Attesting Officer*

*Commissioner of Patents and Trademarks*